US012491598B2

(12) United States Patent
Tsai

(10) Patent No.: US 12,491,598 B2
(45) Date of Patent: Dec. 9, 2025

(54) KNIFE SHARPENING DEVICE

(71) Applicant: Yong Yi International Holding Co., Ltd. Taiwan Branch, New Taipei (TW)

(72) Inventor: Mou-Fu Tsai, Shenzhen (CN)

(73) Assignee: Yong Yi International Holding Co., Ltd. Taiwan Branch, New Taipei (TW)

( * ) Notice: Subject to any disclaimer, the term of this patent is extended or adjusted under 35 U.S.C. 154(b) by 318 days.

(21) Appl. No.: 18/223,146

(22) Filed: Jul. 18, 2023

(65) Prior Publication Data

US 2024/0351155 A1 Oct. 24, 2024

(30) Foreign Application Priority Data

Apr. 19, 2023 (CN) ..... 202320986010.1

(51) Int. Cl.
*B24B 3/54* (2006.01)
*B24B 3/52* (2006.01)

(52) U.S. Cl.
CPC . *B24B 3/54* (2013.01); *B24B 3/52* (2013.01)

(58) Field of Classification Search
CPC .... B24B 3/00; B24B 3/35; B24B 3/52; B24B 3/54
See application file for complete search history.

(56) References Cited

U.S. PATENT DOCUMENTS 3,052,068 A * 9/1962 Burgess ..... B24B 3/54 76/86
3,146,555 A * 9/1964 Posener ..... B24B 3/54 464/46
10,850,361 B1 * 12/2020 Dovel ..... B24D 15/081
2011/0201257 A1 * 8/2011 Walker ..... B24B 3/54 451/45
2018/0104796 A1 * 4/2018 Wu ..... B24D 15/08

FOREIGN PATENT DOCUMENTS

NL 7907256 A * 4/1980 ..... B24B 3/54
WO WO-2020081312 A1 * 4/2020 ..... B24B 51/00

* cited by examiner

*Primary Examiner* — C. A. Rivera
(74) *Attorney, Agent, or Firm* — Birchwood IP

(57) ABSTRACT

The present disclosure provides a knife sharpening device, including a housing and a sharpening assembly arranged inside the housing. The sharpening assembly includes a sharpening wheel rotatably mounted inside the housing. The sharpening wheel includes two opposite mounting surfaces arranged along an axial direction and a sharpening surface along a circumferential direction. The housing is formed thereon with a first sharpening groove that is arranged on a first side of the sharpening surface. The first sharpening groove is formed with openings at both ends along a length direction, and the first side of the sharpening surface extends partially into an interior of the first sharpening groove. During sharpening, a knife is placed into the first sharpening groove to contact the sharpening surface for grinding. According to the technical solution of the present disclosure, sharpening grooves are formed on the housing and fit with the sharpening surface.

7 Claims, 6 Drawing Sheets

KNIFE SHARPENING DEVICE

CROSS-REFERENCE TO RELATED APPLICATIONS

This is a U.S. patent application which claims the priority and benefit of Chinese Patent Application Number 202320986010.1, filed on Apr. 19, 2023, the disclosure of which is incorporated herein by reference in its entirety.

TECHNICAL FIELD

The present disclosure relates to the technical field of knife sharpeners, more particularly to a knife sharpening device.

BACKGROUND

Knife sharpener is a common tool to sharpen knife tools. Compared with conventional whetstones, the knife sharpener has advantages of practicality, high efficiency, convenience, and safety in use, thus being highly popular among consumers in daily life. However, existing knife sharpeners generally have only one sharpening mode, which are limited in application scenarios and cannot meet multiple usage requirements. Further, the contact area of grinding is small, resulting in low efficiency of grinding.

In view of the above, it is necessary to provide a knife sharpening device to address the above defects.

SUMMARY

The main purpose of the present disclosure is to provide a knife sharpening device, to address the problems with the existing knife sharpeners that the contact area of grinding is small and the efficiency of grinding is low.

In order to achieve the above purpose, the present disclosure provides a knife sharpening device, including a housing and a sharpening assembly arranged inside the housing. The sharpening assembly includes a sharpening wheel rotatably mounted inside the housing. The sharpening wheel includes two opposite mounting surfaces arranged along an axial direction and a sharpening surface along a circumferential direction. The housing is formed thereon with a first sharpening groove that is arranged on a first side of the sharpening surface. The first sharpening groove is formed with openings at both ends along a length direction. The first side of the sharpening surface extends partially into an interior of the first sharpening groove. During sharpening, a knife is placed into the first sharpening groove to contact the sharpening surface for grinding.

Preferably, the housing is further formed thereon with a second sharpening groove that is arranged on a second side of the sharpening surface. The second sharpening groove is formed with openings at both ends along a length direction. The second side of the sharpening surface extends partially into an interior of the second sharpening groove.

Preferably, the sharpening wheel is arranged on a top of the housing. The first sharpening groove and the second sharpening groove are both formed on a top surface of the housing.

Preferably, the first sharpening groove and the second sharpening groove are arranged at two ends of the sharpening surface symmetrically. The housing has a position located between the two sharpening grooves further formed with a third sharpening groove. The third sharpening groove is formed with openings at both ends along a length direction. A third side of the sharpening surface extends partially into an interior of the third sharpening groove.

Preferably, an axial line of the sharpening wheel is perpendicular to a height direction of the housing. The first sharpening groove, the second sharpening groove and the third sharpening groove are all formed recessed along an opposite direction of the height direction of the housing.

Preferably, the top surface of the housing is provided convexly with two limit members between the first sharpening groove and the second sharpening groove along the height direction. The two limit members combine to form the third sharpening groove.

Preferably, an outer side wall of the limit member close to the first sharpening groove is flush with a side wall of the first sharpening groove, and an outer side wall of the limit member close to the second sharpening groove is flush with a side wall of the second sharpening groove.

Preferably, a diameter of the sharpening wheel decreases gradually from a connection end toward an outer end along the axial line.

Preferably, the sharpening assembly further includes an electronic control unit that is arranged inside the housing and configured to control a rotation of the sharpening wheel. The electronic control unit includes a PCB board, a rechargeable battery, a motor and a gear set. The rechargeable battery is configured to drive the motor to cause the gear set to rotate, and the gear set causes the sharpening wheel to rotate.

Preferably, a bottom of the housing is provided with a sucking disc. The sucking disc is provided thereon with a fixing assembly configured to fix the sucking disc.

Compared with the existing technologies, the knife sharpening device provided by the present disclosure has the following beneficial effects.

According to the technical solution of the present disclosure, sharpening grooves are formed on the housing, and the sharpening surface of the sharpening wheel extends partially into the sharpening grooves. During usage, a knife is placed into the sharpening groove and contacts the sharpening surface of the sharpening wheel for grinding along the direction of the sharpening groove. When grinding with the sharpening surface of the sharpening wheel along the circumferential direction, the contact area of grinding becomes larger, making the grinded knife sharper, the efficiency of grinding higher and the operation more convenient.

BRIEF DESCRIPTION OF DRAWINGS

For a better understanding of the technical solution in the embodiments of the present disclosure or in the prior art, accompanying drawings required to be used in the description of the embodiments or the prior art are simply illustrated below.

Apparently, the accompanying drawings described below are merely some embodiments of the present disclosure. For the ordinary skill in the field, other accompanying drawings may be obtained according to these accompanying drawings without creative effort.

Figure 1:
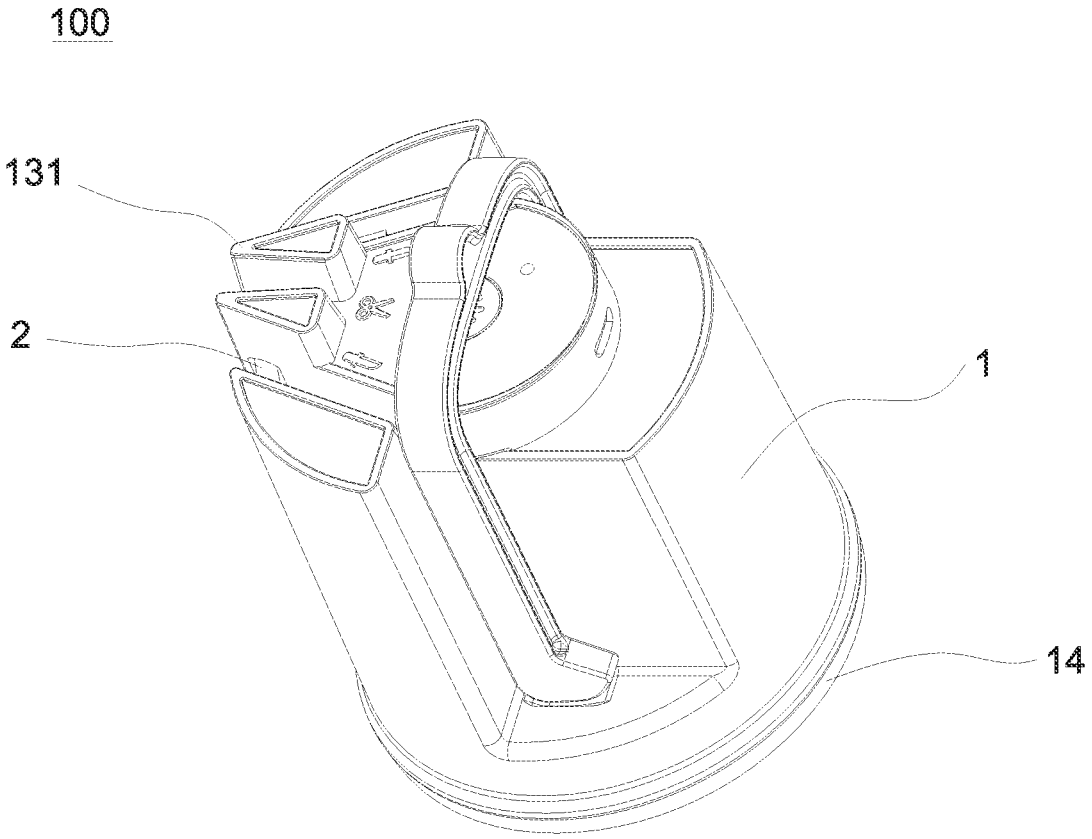
FIG. 1 is an overall structure diagram of one embodiment of a knife sharpening device of the present disclosure.

Below is the description of designators on the drawings.

| Designator | Name | Designator | Name |
|---|---|---|---|
| 100 | Knife sharpening device | 21 | Sharpening wheel |
| 1 | Housing | 211 | Mounting surface |
| 11 | First sharpening groove | 212 | Sharpening surface |
| 12 | Second sharpening groove | 2121 | First side |
| 13 | Third sharpening groove | 2122 | Second side |
| 131 | Limit member | 2123 | Third side |
| 14 | Sucking disc | 22 | Electronic control unit |
| 141 | Fixing assembly | 221 | Rechargeable battery |
| 15 | Charging port | 222 | Motor |
| 2 | Sharpening assembly | 223 | Gear set |

The purpose implementation, function features and advantages of the present disclosure are described below in further detail in combination with embodiments by reference to the drawings.

DETAILED DESCRIPTION

A clear and complete description as below is provided for the technical solution in the embodiments of the present disclosure in conjunction with the drawings in the embodiments of the present disclosure. Apparently, the embodiments described hereinafter are merely part embodiments of the present disclosure, rather than all of the embodiments. All other embodiments obtained by the ordinary skill in the art based on the embodiments in the present disclosure without creative effort are intended to be included in the scope of protection of the present disclosure.

It is to be noted that all directional indications (such as top, bottom, left, right, front, rear . . . ) in the embodiments of the present disclosure are merely to illustrate a relative position relation, a relative motion condition, etc. between each part in a certain state (for example, the state shown in the drawings). If the state changes, the directional indication changes accordingly.

In addition, if terms "first", "second", etc. appear in the present disclosure, they are merely for the purpose of description, but cannot be understood as the indication or implication of relative importance or as the implicit indication of the number of the specified technical features. Therefore, features defined by "first" and "second" may specifically or implicitly include at least one such feature. In addition, technical schemes of each embodiment of the present disclosure may be combined mutually, which, however, must be conducted on the basis that the ordinary skill in this field can implement the combination. When the combination of technical schemes has a conflict or cannot be implemented, it should be considered that such combination of technical schemes does not exist and is not in the scope of protection claimed by the present disclosure.

Referring to FIG. 1 to FIG. 6, the present disclosure provides a knife sharpening device 100. The knife sharpening device 100 includes a housing 1 and a sharpening assembly 2 arranged inside the housing 1. The sharpening assembly 2 includes a sharpening wheel 21 rotatably mounted inside the housing 1. The sharpening wheel 21 includes two opposite mounting surfaces 211 arranged along an axial direction and a sharpening surface 212 along a circumferential direction. The housing 1 is formed thereon with a first sharpening groove 11 that is arranged on a first side 2121 of the sharpening surface 212. The first sharpening groove 11 is formed with openings at both ends along a length direction. The first side 2121 of the sharpening surface 212 extends partially into an interior of the first sharpening groove 11. During sharpening, a knife is placed into the first sharpening groove 11 to contact the sharpening surface 212 for grinding.

Figure 2:
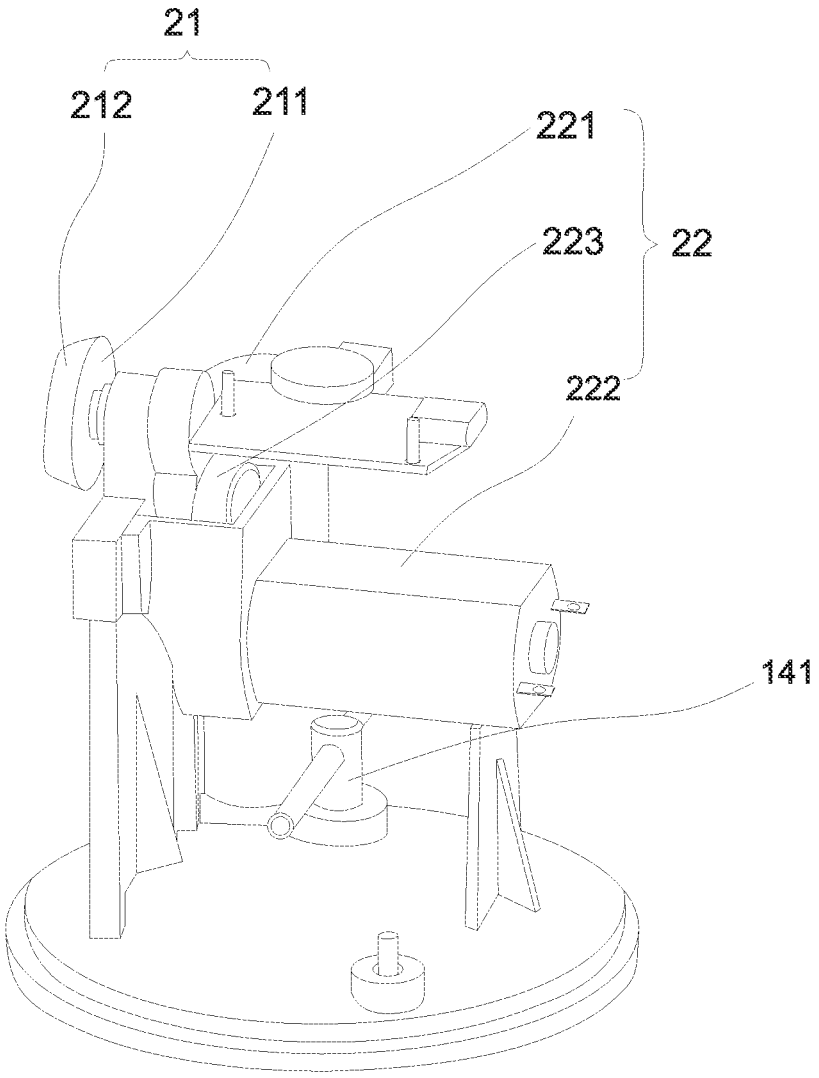
FIG. 2 is an internal structure diagram of one embodiment of a knife sharpening device of the present disclosure.

Specifically, the sharpening assembly 2 is arranged inside the housing 1. The sharpening assembly 2 includes the sharpening wheel 21. The sharpening wheel 21 is rotatably mounted inside the housing 1, wherein the sharpening wheel 21 can be supported and fixed by means of a bracket, or rotatably connected onto an inner wall of the housing 1. As shown in FIG. 2, the sharpening wheel 21 includes two opposite mounting surfaces 211 arranged along an axial direction and a sharpening surface 212 along a circumferential direction. That is, the two surfaces along the axial direction are used for mounting and fixing, and the sharpening surface 212 along the circumferential direction is used for grinding.

In detail, the first sharpening groove 11 is formed on the housing 1. The first sharpening groove 11 is formed with openings at both ends along the length direction, so that the knife is pushed and pulled for grinding along the length direction. The first sharpening groove 11 is arranged on the first side 2121 of the sharpening surface 212. The first side 2121 of the sharpening surface 212 refers to one side surface of the sharpening surface 212 in any direction. The first sharpening groove 11 includes a bottom surface and two side walls. The side wall of the first sharpening groove 11 is formed with a notch, and the first side 2121 of the sharpening surface 212 extends into the interior of the first sharpening groove 11 through the notch. During sharpening, the knife can contact the sharpening surface 212 for grinding when placed into the first sharpening groove 11.

It should be understood that conventional knife sharpeners grind a knives using two opposite surfaces arranged along an axial direction. During the sharpening course, the surfaces of the knife sharpeners are likely to suffer non-uniform abrasion, resulting in angular differences thereon, whereby the contact area of grinding becomes smaller for later sharpening operations, so that there are only tangent lines or points on the surface used for grinding.

In the present disclosure, an end surface of the sharpening wheel 21 along the circumferential direction is arranged as the sharpening surface 212, and the first sharpening groove 11 is arranged to fit with the sharpening surface 212. During sharpening, the knife is placed into the first sharpening groove 11 and then contacts the sharpening surface 212 of the sharpening wheel 21 along the circumferential direction. Since the sharpening surface 212 is arranged circumferentially, the contact area between the sharpening surface 212 and the knife becomes larger. Even though a certain part of the sharpening surface 212 is abraded, the other parts of the sharpening surface 212 are still uniform. The sharpening wheel 21 is rotated to grind the knife, whereby the grinded knife is sharper. The knife can be grinded quickly and effectively.

According to the technical solution of the present disclosure, sharpening grooves are formed on the housing 1, and the sharpening surface 212 of the sharpening wheel 21 extends partially into the sharpening grooves. During usage, a knife is placed into the sharpening groove and contacts the sharpening surface 212 of the sharpening wheel 21 for grinding along the direction of the sharpening groove. When grinding with the sharpening surface 212 of the sharpening wheel 21 along the circumferential direction, the contact area of grinding becomes larger, making the grinded knife sharper, the efficiency of grinding higher and the operation more convenient.

In one preferred embodiment of the present disclosure, the housing 1 is further formed thereon with a second sharpening groove 12 that is arranged on a second side 2122 of the sharpening surface 212. The second sharpening groove 12 is formed with openings at both ends along a length direction, and the second side 2122 of the sharpening surface 212 extends partially into an interior of the second sharpening groove 12.

It is to be noted that the second sharpening groove 12 is formed on the housing 1. The second sharpening groove 12 is arranged on the second side 2122 of the sharpening surface 212. The first side 2121 and the second side 2122 of the sharpening surface 212 refer to one side and the other side of the sharpening surface 212 of the sharpening wheel 21 along the circumferential direction, which do not belong to the same side, with specific position not limited. The second side 2122 may be arranged next to the first side 2121, or opposite the first side 2121, only if the knife can be placed into the sharpening groove to contact the sharpening surface 212 for grinding and the knife can have the opposite surface grinded when in the second sharpening groove 12.

The second sharpening groove 12 is formed with openings at both ends along a length direction, so that the knife is pushed and pulled for grinding along the length direction. The side wall of the second sharpening groove 12 is formed with a notch, and the second side 2122 of the sharpening surface 212 extends into the interior of the second sharpening groove 12 through the notch, whereby during sharpening, the knife can contact the sharpening surface 212 of the sharpening wheel 21 along the circumferential direction for grinding when placed into the second sharpening groove 12.

It should be understood that when there is only the first sharpening groove 11 arranged for grinding, the knife needs to be turned over by 180 degrees for grinding of a second surface after the grinding of a first surface thereof is completed. When the second sharpening groove 12 is arranged, after the grinding of the first surface is completed, it is only needed to withdraw the knife and place it into the second sharpening groove 12, whereby to grind the second surface. The operation is more convenient, and the efficiency is higher.

In one preferred embodiment of the present disclosure, the sharpening wheel 21 is arranged on a top of the housing 1. The first sharpening groove 11 and the second sharpening groove 12 are both formed on a top surface of the housing 1.

It is understandable that the sharpening wheel 21 can be arranged on a side surface of the housing 1, or on a top surface of the housing 1. The first sharpening groove 11 and the second sharpening groove 12 can be arranged on the side surface or top surface of the housing 1 accordingly depending on the position of the sharpening wheel 21.

In the present embodiment, the sharpening wheel 21 is arranged on the top of the housing 1, and the first sharpening groove 11 and the second sharpening groove 12 are both formed on the top surface of the housing 1. During sharpening, a knife can be held by hand to place into the sharpening groove for grinding from the top of the knife sharpening device 100, whereby the operation is more convenient.

In one preferred embodiment of the present disclosure, the first sharpening groove 11 and the second sharpening groove 12 are arranged at two ends of the sharpening surface 212 symmetrically. The housing has a position 1 located between the two sharpening grooves further formed with a third sharpening groove 13. The third sharpening groove 13 is formed with openings at both ends along a length direction. A third side 2133 of the sharpening surface 212 extends partially into an interior of the third sharpening groove 13.

Figure 3:
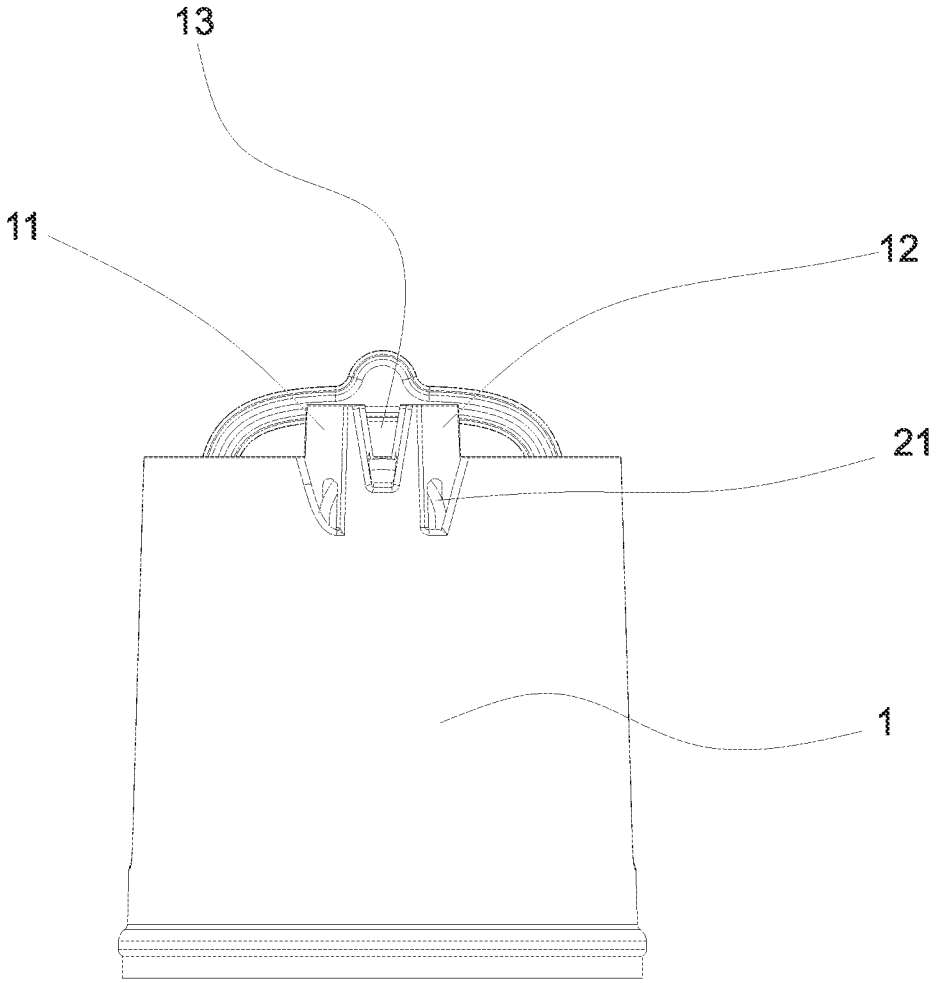
FIG. 3 is a front view of one embodiment of a knife sharpening device of the present disclosure.
Figure 4:
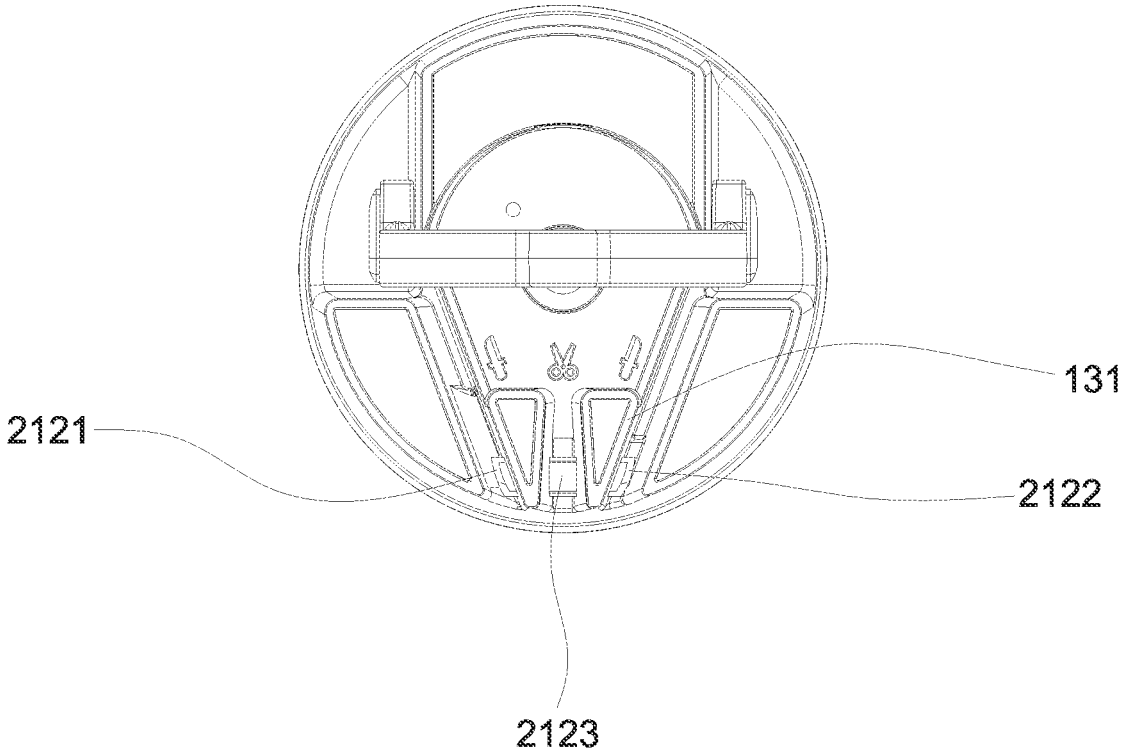
FIG. 4 is a top view of one embodiment of a knife sharpening device of the present disclosure.
Figure 5:
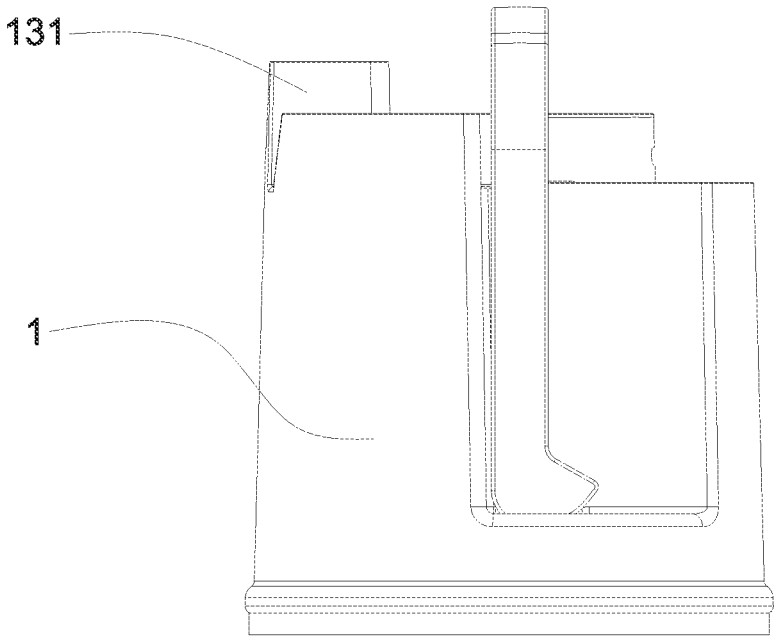
FIG. 5 is a side view of one embodiment of a knife sharpening device of the present disclosure.
Figure 6:
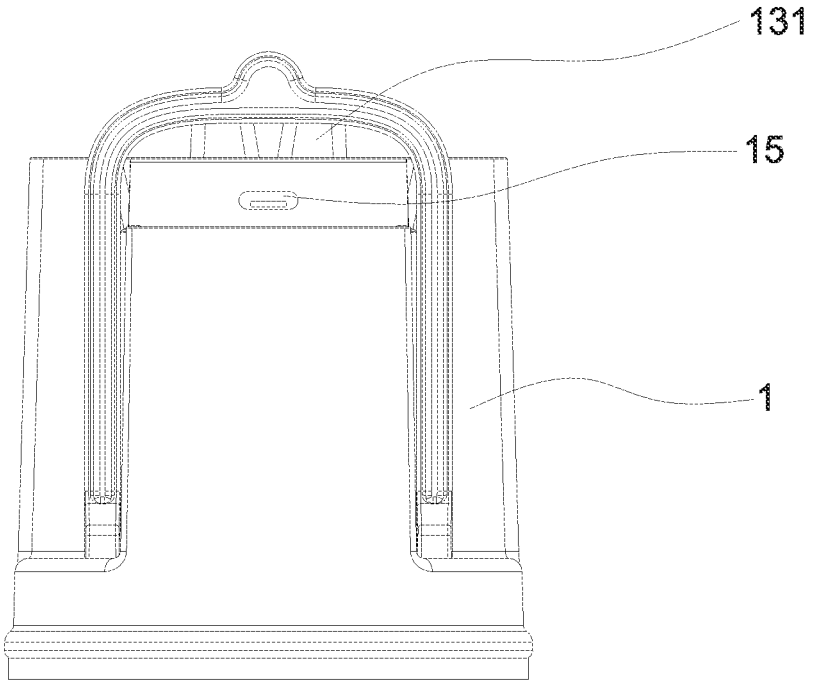
FIG. 6 is a rear view of one embodiment of a knife sharpening device of the present disclosure.

In detail, the third sharpening groove 13 is further arranged. As shown in FIG. 3 to FIG. 4, the first sharpening groove 11 and the second sharpening groove 12 are arranged at two ends of the sharpening surface 212 symmetrically along a radial direction. From the drawings, the third side 2133 of the sharpening wheel 21 is located between the first side 2121 and the second side 2122, and the third sharpening groove 13 is arranged between the first sharpening groove 11 and the second sharpening groove 12.

The third sharpening groove 13 is formed with openings at both ends along the length direction, so that a knife is pushed and pulled for grinding along the length direction. The side wall of the third sharpening groove 13 is formed with a notch, and the third side 2123 of the sharpening surface 212 extends into the interior of the third sharpening groove 13 through the notch. During sharpening, the knife can contact the sharpening surface 212 for grinding when placed into the third sharpening groove 13. The third sharpening groove 13 is arranged to grind tools such as scissors, enlarging the application scenarios of the sharpening device and meeting multiple usage requirements.

Further, an axial line of the sharpening wheel 21 is perpendicular to a height direction of the housing 1. The first sharpening groove 11, the second sharpening groove 12 and the third sharpening groove 13 are all formed recessed along an opposite direction of the height direction of the housing 1.

It should be understood that the sharpening wheel 21 can be placed as actually needed when arranged on the top of the housing 1, where it can be placed horizontally or vertically. In the present embodiment, the sharpening wheel 21 is placed vertically, the axial line of the sharpening wheel 21 is perpendicular to the height direction of the housing 1. The three sharpening grooves are all formed recessed along the opposite direction of the height direction of the housing 1, so that during sharpening, a knife can be vertically placed into the sharpening groove for grinding from the top, whereby the operation is more convenient.

In one preferred embodiment of the present disclosure, the top surface of the housing 1 is provided convexly with two limit members 131 between the first sharpening groove 11 and the second sharpening groove 12 along the height direction. The two limit members 131 combine to form the third sharpening groove 13.

In detail, the top surface of the housing 1 is provided convexly with two limit members 131 along the height direction. The limit members 131 are located between the first sharpening groove 11 and the second sharpening groove 12 and combine to form the third sharpening groove 13. The limit members 131 are added so that the tools such as scissors can be placed into the third sharpening groove 13 for grinding and meanwhile do not interfere with the first sharpening groove 11 and the second sharpening groove 12.

In one preferred embodiment of the present disclosure, an outer side wall of the limit member 131 close to the first sharpening groove 11 is flush with a side wall of the first sharpening groove 11, and an outer side wall of the limit member 131 close to the second sharpening groove 12 is flush with a side wall of the second sharpening groove 12.

Specifically, the third sharpening groove 13 is formed by two limit members 131 arranged opposite. The outer side wall of the limit member 131 close to the first sharpening groove 11 is arranged flush with the side wall of the first sharpening groove 11, and the outer side wall of the limit member 131 close to the second sharpening groove 12 is arranged flush with the side wall of the second sharpening groove 12, so that the limit members 131 are arranged not to affect the first sharpening groove 11 and the second sharpening groove 12, whereby a knife can be conveniently grinded in the first sharpening groove 11 and the second sharpening groove 12.

Further, a diameter of the sharpening wheel 21 decreases gradually from a connection end toward an outer end along the axial line.

It is to be noted that in the present embodiment the diameter of the sharpening wheel 21 is arranged decreasing gradually from the connection end toward the outer end along the axial line. The connection end refers to one end fixing the sharpening wheel 21, and the outer end refers to one end of the sharpening wheel 21 away from the fixing end, arranged close to the outside of the housing 1.

As shown in FIG. 2 to FIG. 4, the sharpening surface 212 of the sharpening wheel 21 along the circumferential direction is titled by certain angle. The first sharpening groove 11 is arranged tilted along the length direction corresponding to the sharpening surface 212 on the first side 2121, and the second sharpening groove 12 is arranged tilted along the length direction corresponding to the sharpening surface 212 on the second side 2122, whereby during sharpening, a knife can fully contact the sharpening surface 212 to improve the grinding efficiency.

In one preferred embodiment of the present disclosure, the sharpening assembly 2 further includes an electronic control unit 22 that is arranged inside the housing 1 and configured to control a rotation of the sharpening wheel 21. The electronic control unit 22 includes a PCB board, a rechargeable battery 221, a motor 222 and a gear set 223. The rechargeable battery 221 is configured to drive the motor 222 to cause the gear set 223 to rotate, and the gear set 223 causes the sharpening wheel 21 to rotate.

Specifically, the sharpening assembly 2 further includes the electronic control unit 22 that is configured to control the rotation of the sharpening wheel 21, whereby to quickly grind a knife. The electronic control unit 22 includes the PCB board (not shown in drawings), the rechargeable battery 221, the motor 222 and the gear set 223. The rechargeable battery 221 is fixed on a bottom plate of the housing 1. The motor 222 and the gear set 223 are supported and fixed by means of a bracket. One end of the gear set 223 is connected to an output end of the motor 222, and the other end of the gear set 223 is connected to the sharpening wheel 21 through a transmission shaft. The rechargeable battery 221 is configured to drive the motor 222 to cause the gear set 223 to rotate, and the gear set 223 causes the sharpening wheel 21 to rotate.

With the electronic control unit 22 arranged to control the rotation of the sharpening wheel 21, an electric mode is enabled for sharpening that can greatly improve the efficiency of grinding, whereby achieving the effect of quick grinding of knives. A charging port 15 is formed on a side wall of the housing 1 away from the sharpening wheel 21. By means of the rechargeable battery 221, space and environment constraints can be broken through, the knife sharpening device can be used anytime and anywhere and can be operated continuously, greatly improving the operating convenience.

In one preferred embodiment of the present disclosure, a bottom of the housing 1 is provided with a sucking disc 14, and the sucking disc 14 is provided thereon with a fixing assembly 141 configured to fix the sucking disc 14.

In detail, the bottom of the housing 1 is further provided with the sucking disc 14, and the sucking disc 14 is provided thereon with the fixing assembly 141 configured to fix the sucking disc 14. The fixing assembly 141 may be a pull rod or a control handle, etc. Through the sucking disc 14 connected thereto, the device when in use can be fixed by a suction force generated by the sucking disc 14. The sucking disc 14 can firmly adhere to a smooth place, which is not affected by usage environment and space and requires no hand fixing, thus effectively avoiding dangers occurring to operators and achieving higher safety in use.

The above are preferred embodiments of the present disclosure merely and are not intended to limit the patent scope of the present disclosure. Any equivalent structures made according to the description and the accompanying drawings of the present disclosure under the thought of the present disclosure or applied to other relevant technical fields directly or indirectly are intended to be included in the patent protection scope of the present disclosure.

What is claimed is:

1. A knife sharpening device, comprising a housing and a sharpening assembly arranged inside the housing;

the sharpening assembly comprising a sharpening wheel rotatably mounted inside the housing, the sharpening wheel comprising two opposite mounting surfaces arranged along an axial direction and a sharpening surface along a circumferential direction;

the housing being formed thereon with a first sharpening groove that is arranged on a first side of the sharpening surface, the first sharpening groove being formed with openings at both ends along a length direction, and the first side of the sharpening surface extending partially into an interior of the first sharpening groove;

wherein the housing is further formed thereon with a second sharpening groove that is arranged on a second side of the sharpening surface, the second sharpening groove is formed with openings at both ends along a length direction, and the second side of the sharpening surface extends partially into an interior of the second sharpening groove;

wherein the sharpening wheel is arranged on a top of the housing, and the first sharpening groove and the second sharpening groove are both formed on a top surface of the housing;

wherein the first sharpening groove and the second sharpening groove are arranged at two ends of the sharpening surface symmetrically, the housing has a position located between the two sharpening grooves further formed with a third sharpening groove, the third sharpening groove is formed with openings at both ends along a length direction, and a third side of the sharpening surface extends partially into an interior of the third sharpening groove; and wherein the sharpening surface is configured for grinding a knife placed into the first sharpening groove, the second sharpening groove, or the third sharpening groove.

2. The knife sharpening device according to claim 1, wherein an axial line of the sharpening wheel is perpendicular to a height direction of the housing, and the first sharpening groove, the second sharpening groove and the third sharpening groove are all formed recessed along an opposite direction of the height direction of the housing.

3. The knife sharpening device according to claim 2, wherein the top surface of the housing is provided convexly with two limit members between the first sharpening groove and the second sharpening groove along the height direction, and the two limit members combine to form the third sharpening groove.

4. The knife sharpening device according to claim 3, wherein an outer side wall of the limit member close to the first sharpening groove is flush with a side wall of the first sharpening groove, and an outer side wall of the limit member close to the second sharpening groove is flush with a side wall of the second sharpening groove.

5. The knife sharpening device according to claim 4, wherein a diameter of the sharpening wheel decreases gradually from a connection end toward an outer end along the axial line.

6. The knife sharpening device according to claim 1, wherein the sharpening assembly further comprises an electronic control unit that is arranged inside the housing and configured to control a rotation of the sharpening wheel;

the electronic control unit comprises a PCB board, a rechargeable battery, a motor and a gear set; the rechargeable battery is configured to drive the motor to cause the gear set to rotate, and the gear set causes the sharpening wheel to rotate.

7. The knife sharpening device according to claim 1, wherein a bottom of the housing is provided with a sucking disc, and the sucking disc is provided thereon with a fixing assembly configured to fix the sucking disc.

* * * * *